United States Patent [19]

Copprue

[11] Patent Number: 4,942,627

[45] Date of Patent: Jul. 24, 1990

[54] SCARF

[76] Inventor: Judy Copprue, 6521 Baccich St., New Orleans, La. 70122

[21] Appl. No.: 348,385

[22] Filed: May 8, 1989

[51] Int. Cl.[5] ..... A41D 23/00

[52] U.S. Cl. ..... 2/207; 2/91

[58] Field of Search ..... 2/171, 174, 206, 207, 2/91

[56] References Cited

U.S. PATENT DOCUMENTS

| | | | |
|---|---|---|---|
| 2,117,973 | 5/1938 | Misewicz et al. | 2/91 |
| 2,385,791 | 10/1945 | Bye | 2/91 |
| 2,413,318 | 12/1946 | Golfieri | 2/207 |
| 2,421,934 | 6/1947 | Golfieri | 2/207 |
| 2,704,368 | 3/1955 | Swartz | 2/207 |
| 2,942,274 | 6/1960 | Ross | 2/207 |
| 3,733,614 | 5/1973 | Abramowitz | 2/91 X |
| 4,321,709 | 3/1982 | Steinberg | 2/91 X |
| 4,613,992 | 9/1986 | Dabbieri | 2/207 X |

*Primary Examiner*—Werner H. Schroeder
*Assistant Examiner*—Jeanette E. Chapman
*Attorney, Agent, or Firm*—Thomas S. Keaty

[57] ABSTRACT

The invention relates to articles of clothing, and more particularly to scarves. The scarf provides for the use of a substantially elongated body having a square portion and a rectangular portion integrally connected to each other. A loop is formed in a free end of the rectangular portion, through which corners of the square portion are pulled to tie a scarf of various modes and loops. The scarf remains tied, without the use of pins, broaches or other securing means.

5 Claims, 2 Drawing Sheets

SCARF

BACKGROUND OF THE INVENTION

The present invention relates to articles of clothing, and more specifically to scarves to be worn around a neck, waist or a head of the user.

It has become fashionable in recent years to accessorize an outfit with a scarf, as a result of which numerous dimension scarves have been offered on the market, the scarves made of various fabrics, having numerous print design variations and varying in the shape of the scarf from rectangular to a square. However, some of the users find it difficult to tie the scarf in more than a few methods and find it entirely frustrating to attempt to tie a scarf to present a new look. Additionally, some of the methods of tying a scarf tend to prevent the scarf from being tied tightly, thus causing considerable annoyance to the user, who has to re-tie the scarf again, often in the absence of a mirror.

It is, therefore, an object of the present invention to provide an improved scarf design, which allows the user to vary the methods of tying the scarf with one basic scarf, continuously changing the resulting look.

It is a further object of the present invention to provide an improved scarf which enables a user to securely tie a scarf and retain the scarf in the tied manner regardless of movements of the user or exterior conditions, such as wind.

These and other objects of the present invention will be more apparent to those skilled in the art from the following description of the invention.

SUMMARY OF THE INVENTION

The present invention achieves its objects and overcomes the shortcomings of the prior art in a simple and straightforward manner.

The invention provides for the use of a substantially elongated scarf body having a first generally square portion and a second generally rectangular portion. The first and second portions are integrally connected to each other, so that one side of the square portion and one side of the rectangular portion form a continuous line.

A free end of the rectangular portion is folded over and stitched to the scarf body to form a loop.

The length of the rectangular portion can vary, depending on applications, as well as the width of the rectangular portion and dimensions of the square portion.

In operation, a corner of the rectangular portion is pulled through the loop formed in the rectangular portion to tie the scarf allowing creation of various modes of tying the scarf. The scarf so tied can be worn on a neck, waist or head of a user.

DETAILED DESCRIPTION OF THE PREFERRED EMBODIMENT

Figure 1:
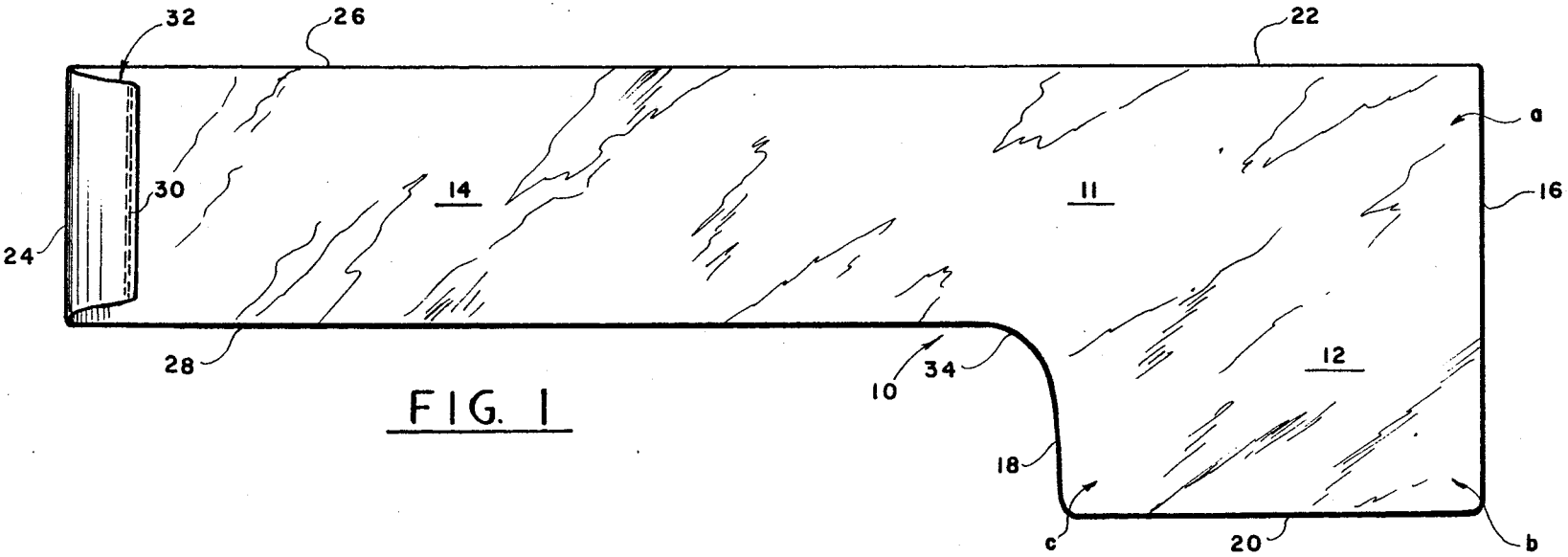
FIG. 1 is a perspective view of a first embodiment of the scarf in accordance with the present invention.

Reference will now be made to the drawings, wherein like numerals designate like parts, and wherein numeral 10 designates a scarf in accordance with the first embodiment of the present invention. As can be seen in FIG. 1, the scarf comprises a scarf body 11 having a first portion 12 and a second portion 14 integrally connected to the portion 12. The portion 12 has a first end 16, a second end 18 and sides 20 and 22, respectively. The portion 14 has a free end 24, a side 26, which is continuous with the side 22 of the portion 12 and a side 28 opposite from the side 26. The second end of the portion 14 is integral with the portion 12 as can be seen in FIG. 1.

The free end 24 of portion 14 is folded over, towards the portion 12 and is secured, such as by stitching along a line 30 to the scarf body 11. As a result, a loop 32 is formed in the end 24 of portion 14.

The portion 12 has a generally square shape, while the portion 14 is generally rectangular, and longer along its sides 26 and 28 then along its end 24. A place of connection between end 18 of the portion 12 and side 28 of the portion 14 may be rounded as at 34 or straight, forming a 90° angle between the end 18 and side 28. The most distant part of end 24 is preferably cut at an angle and is narrower than the remainder width of the portion 14. In this manner, a better looking, neater loop body is formed, with the ends of the loop not seen from the "right side" of the scarf when it is tied.

Figure 2:
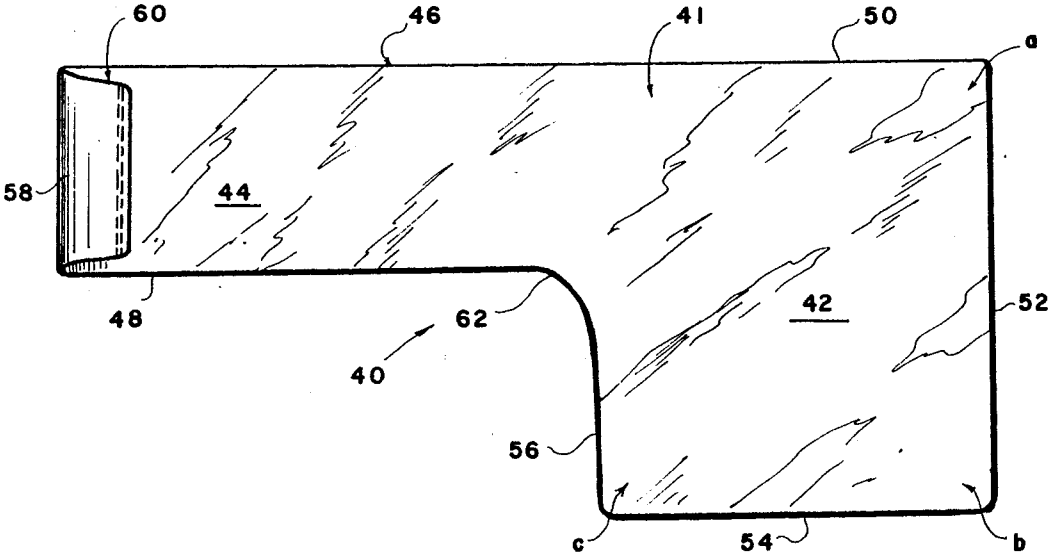
FIG. 2 is a perspective view showing a second embodiment of the scarf in accordance with the present invention.

The second embodiment of the scarf in accordance with the present invention (FIG. 2) illustrates a design similar to the design shown in FIG. 1, but for the proportions of the portion 44, which is substantially shorter along sides 46 and 48 then the sides 26 and 28 of the embodiment shown in FIG. 1. The scarf 40 of the embodiment in FIG. 2 comprises a scarf body 41 having a first portion 42 and a second portion 44 which are integrally connected to each other, so that their sides 50 and 46, respectively, form a continuous line. The portion 42 is further limited by a free end 52, second side 54 and second end 56. The portion 44 has one free end 58 opposite the end 52 of the portion 42.

Similarly to the loop 32 of the portion 14, a loop 60 is formed in the end 58 of the portion 44 which end is folded towards the portions 42 and secured by stitching to the scarf body 41.

The end 56 and the side 48 meet at a curved line 62 or can form a right angle connection, if so desired.

For an ease of understanding of the methods of tying the scarves 10 and 40, the corners of portions 12 and 42 will be designated by letters a, b and c. The corner "a" is formed by sides 22 and 50 and ends 16 and 52 of the scarves 10 and 40, respectively. The corner "b" is formed by the ends 16, 52 and sides 20 and 54 of the scarves 10 and 40, respectively.

The corner "c" is formed by the sides 20, 54 and ends 18 and 56 of the scarves 10 and 40, respectively.

It should be noted that scarves 10 and 40 may be tied in a similar manner, so that the reference will be made only to the scarf 10 now to illustrate the methods of using the scarf.

Reference will now be made to FIGS. 3–10, illustrating the modes of tying the scarf 10 or 40 in accordance with the present invention.

Figure 3:
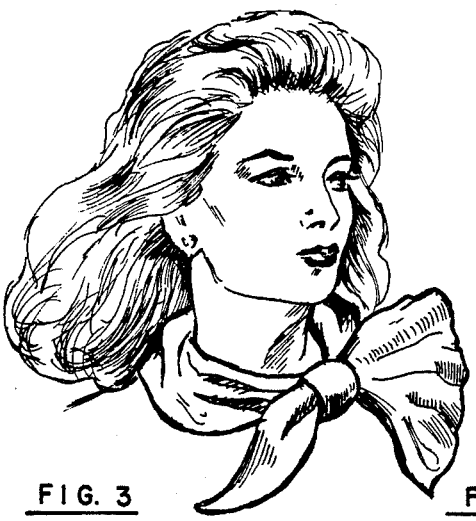
FIGS. 3–10 illustrate various methods by which the scarf of the present invention can be tied.

In order to achieve the result of scarf tying shown in FIG. 3, corner "a" is pulled through the loop 32, to the desired distance, allowing corners "b" and "c" to remain unpulled through the loop and spreading the corners "b" and "c" over one's shoulder.

Figure 4:
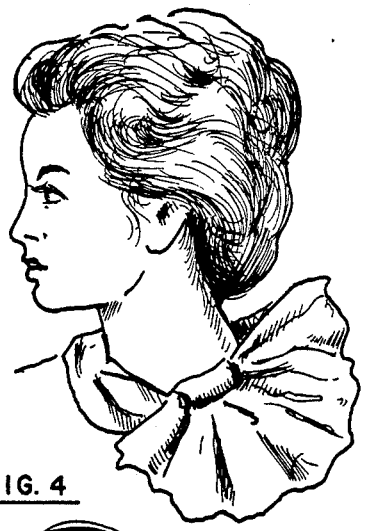

In order to achieve the look shown in FIG. 4, a corner "b" is pulled through the loop, while corners "a" and "c" remain unpulled. They are then spread open and can be worn over the shoulder or in front, as desired.

Figure 5:
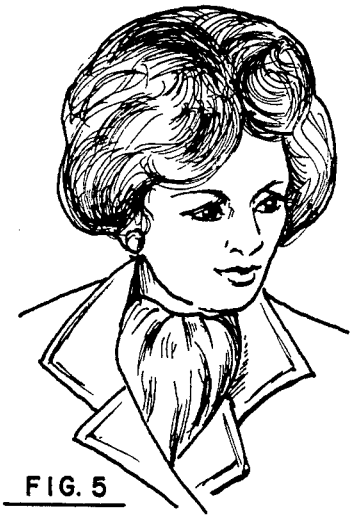

In order to achieve the look shown in FIG. 5, corner "b" is pulled through the loop, behind the loop and over, folding the scarf in "ascot" style.

Figure 6:
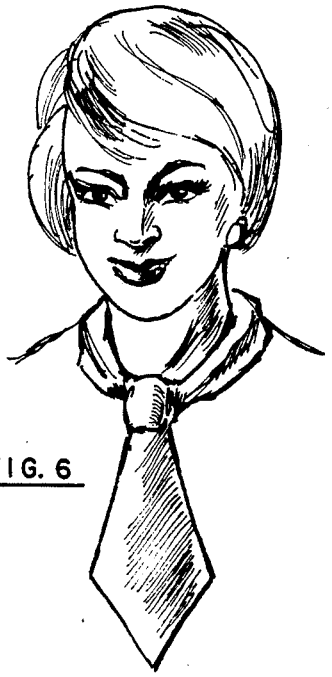

In order to achieve the look shown in FIG. 6, the corner "b" is pulled through the loop, then entire square portion is pulled to the front, folding back corners "a" and "c", and pinning them to produce a "man's" tie appearance.

Figure 7:
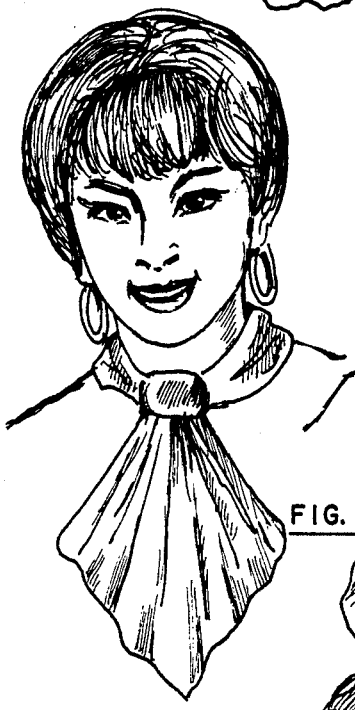

In order to achieve the look shown in FIG. 7, the procedure for FIG. 6 is repeated, with the exception that the corners "a" and "c" are not folded back and pinned, but rather spread in the front.

Figure 8:
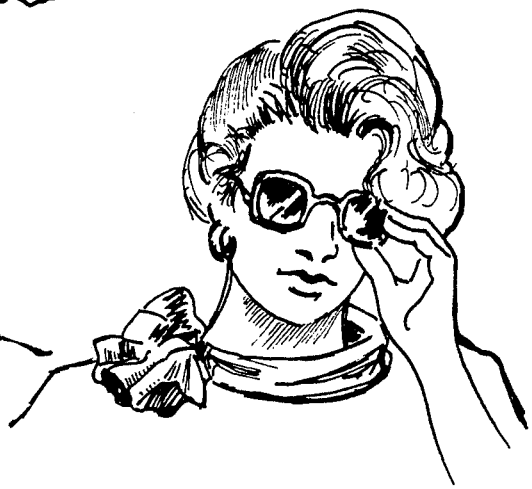

In order to achieve the look in FIG. 8, a rectangular portion of smaller dimensions is used (FIG. 2), pulling first corner "a" through the loop 32 and moving the loop to the side of the neck, over a person's shoulder.

Figure 9:
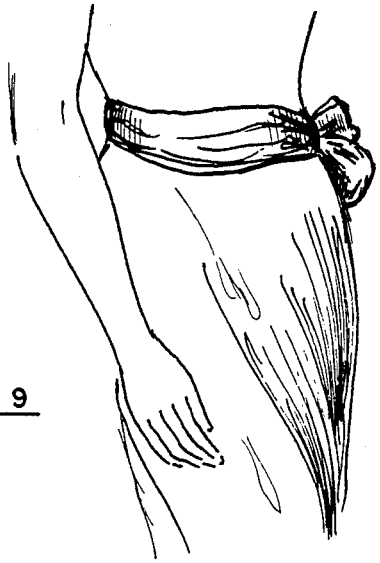

In order to tie a scarf around the waist, the embodiment shown in FIG. 9, a scarf body with longer rectangular portion 14 is used (FIG. 1). The procedure similar to the embodiment shown in FIG. 8 is used in order to produce a fashionable tie.

Figure 10:
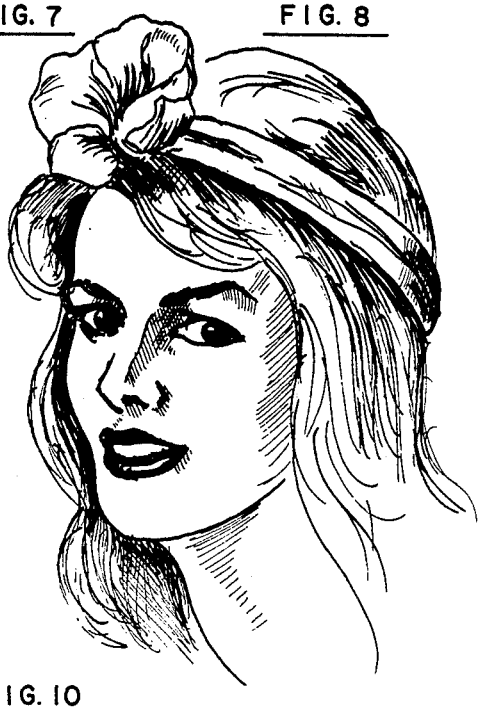

Finally, as shown in FIG. 10, the scarf 10 can be worn on the head of a user. For this purpose, the embodiment shown in FIG. 2 would be more suitable, wherein the rectangular portion is of shorter dimensions as compared to the embodiment shown in FIG. 1.

To achieve the "flower" look of the tied scarf, the square portion 42 is folded, starting with the side 43 towards the side 50. The square portion can be folded 1 or 2 times, so as to present an elongated ribbon. The end 52 is then pulled through the loop 60, with the portion 42 folded one or two times. The ends of the portion 42 are then unfolded and opened.

As can be seen from the drawings, multiple variations of the modes of tying the scarf can be achieved with the same basic scarf structure, making the scarf of the present invention a practically universal scarf.

As can be easily appreciated, the design on the fabric itself, the fabric from which the scarf is made, as well as dimensions of the square and rectangular portions, depending on the taste and intentions of the user can be changed indefinitely.

Many other modifications can be made in the embodiments of the present invention without departing from the spirit and scope thereof. I, therefore, pray that my rights to the present invention be limited only by the scope of the appended claims.

I claim:

1. A scarf, comprising:

a substantially elongated flexible scarf body having a first substantially square portion and a second substantially rectangular portion narrower in width than the first portion integrally connected to the first portion about one of its ends, one side of the second portion and an adjacent side of the first portion being curved at a part of attachment of said one side to said adjacent side, a free end of the second portion having a reduced width; and wherein the free end of the second portion is folded over towards the first portion and secured to the second portion forming a loop, the loop being adapted to receive at least a part of the first portion therethrough to ensure secure tying of the scarf.

2. The scarf of claim 1, wherein one side of the first portion and one side of the second portion form a continuous side of the scarf body.

3. A method of tying a scarf comprising the following steps:

providing a flexible scarf body having a first square portion and a second rectangular portion integrally connected to the first portion about one of its ends, providing a transition between the sides which is curved providing a reduced-width free end on the second portion, providing said free end with a loop by securing said free end to the second portion; and drawing at least a corner of the first portion through the loop means, thus securely tying the scarf.

4. The method of claim 3, wherein one side of the first portion and one side of the second portion form a continuous side of the scarf body.

5. The method of claim 3, wherein the loop is formed by folding the free end of the second portion towards the first portion and securing the free end to the scarf body.

* * * * *